US009648930B1

(12) United States Patent
Mejia

(10) Patent No.: US 9,648,930 B1
(45) Date of Patent: May 16, 2017

(54) FLOATABLE UMBRELLA WITH SELF-BALLASTING MEMBER

(71) Applicant: Jaime Mejia, Coconut Creek, FL (US)

(72) Inventor: Jaime Mejia, Coconut Creek, FL (US)

( * ) Notice: Subject to any disclaimer, the term of this patent is extended or adjusted under 35 U.S.C. 154(b) by 0 days.

(21) Appl. No.: 15/083,634

(22) Filed: Mar. 29, 2016

(51) Int. Cl.
*A45B 23/00* (2006.01)
*A45B 25/02* (2006.01)
*B63B 22/00* (2006.01)
*A45B 19/02* (2006.01)

(52) U.S. Cl.
CPC ..... *A45B 23/00* (2013.01); *A45B 19/02* (2013.01); *A45B 25/02* (2013.01); *B63B 22/00* (2013.01)

(58) Field of Classification Search
CPC ..... A45B 3/00; A45B 19/02; A45B 25/02; B63B 7/08; B63B 21/04; B63B 22/00; B63B 17/02; B63C 9/08
USPC ..... 135/16, 98, 20.2; 441/23, 27, 38, 88, 441/130–131, 134; 116/173, 326, 123
See application file for complete search history.

(56) References Cited

U.S. PATENT DOCUMENTS 1,764,852 A 6/1930 Thomas
2,368,558 A * 1/1945 Maloney ..... B63C 9/115 441/108
4,796,553 A * 1/1989 Cogswell ..... G09F 17/00 116/173
4,799,910 A * 1/1989 Kellough ..... B63B 35/76 441/130
5,299,588 A * 4/1994 MacLeod ..... A45B 11/00 135/16
5,394,822 A 3/1995 Worland
5,505,645 A * 4/1996 Engler, Jr. ..... A45B 23/00 135/16
5,518,431 A * 5/1996 Staley ..... B63B 35/76 114/345
5,572,750 A * 11/1996 Johnston ..... E04H 4/14 4/494
5,662,304 A * 9/1997 McDaniel ..... E04H 12/2223 248/499
D413,488 S 9/1999 Foley
6,209,147 B1 4/2001 Wheaton
7,303,453 B1 * 12/2007 Bourke ..... B63B 22/22 441/30
7,975,327 B2 7/2011 Switzer
D652,615 S 1/2012 Paolucci
8,187,047 B1 5/2012 Brooks
9,028,288 B2 * 5/2015 Lovett ..... A45B 3/00 441/1
2011/0065342 A1 * 3/2011 Hudson ..... A01K 75/04 441/16
2012/0090525 A1 4/2012 Montgomery
(Continued)

FOREIGN PATENT DOCUMENTS

WO 9305688 A1 4/1993

*Primary Examiner* — Winnie Yip

(57) ABSTRACT

The floatable umbrella with self-ballasting member includes an umbrella that is selectively attached to an umbrella float. An umbrella weight is selectively attached to a distal end of the umbrella so as to form a ballasting capability for the umbrella when said umbrella is partially submerged within a body of water. A tether is selectively attached to the umbrella float. The tether includes a wristband on a distal end, which is adapted to engage a wrist of an end user. The tether may optionally include a tether float as well as a magnet release that separates between the tether float and the wristband.

6 Claims, 4 Drawing Sheets

(56) References Cited

U.S. PATENT DOCUMENTS

| | | | | |
|---|---|---|---|---|
| 2014/0227920 | A1 | 8/2014 | Lovett | |
| 2014/0346824 | A1* | 11/2014 | Harrison | A47C 15/006 297/219.1 |
| 2015/0225041 | A1* | 8/2015 | Lovett | A43B 3/108 441/21 |

* cited by examiner

FLOATABLE UMBRELLA WITH SELF-BALLASTING MEMBER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of umbrellas, more specifically, an umbrella that is able to float upright in a body of water.

SUMMARY OF INVENTION

The floatable umbrella with self-ballasting member includes an umbrella that is selectively attached to an umbrella float. An umbrella weight is selectively attached to a distal end of the umbrella so as to form a ballasting capability for the umbrella when said umbrella is partially submerged within a body of water. A tether is selectively attached to the umbrella float. The tether includes a wristband on a distal end, which is adapted to engage a wrist of an end user. The tether may optionally include a tether float as well as a magnet release that separate between the tether float and the wristband.

These together with additional objects, features and advantages of the floatable umbrella with self-ballasting member will be readily apparent to those of ordinary skill in the art upon reading the following detailed description of the presently preferred, but nonetheless illustrative, embodiments when taken in conjunction with the accompanying drawings.

In this respect, before explaining the current embodiments of the floatable umbrella with self-ballasting member in detail, it is to be understood that the floatable umbrella with self-ballasting member is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the floatable umbrella with self-ballasting member.

It is therefore important that the claims be regarded as including such equivalent construction insofar as they do not depart from the spirit and scope of the floatable umbrella with self-ballasting member. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
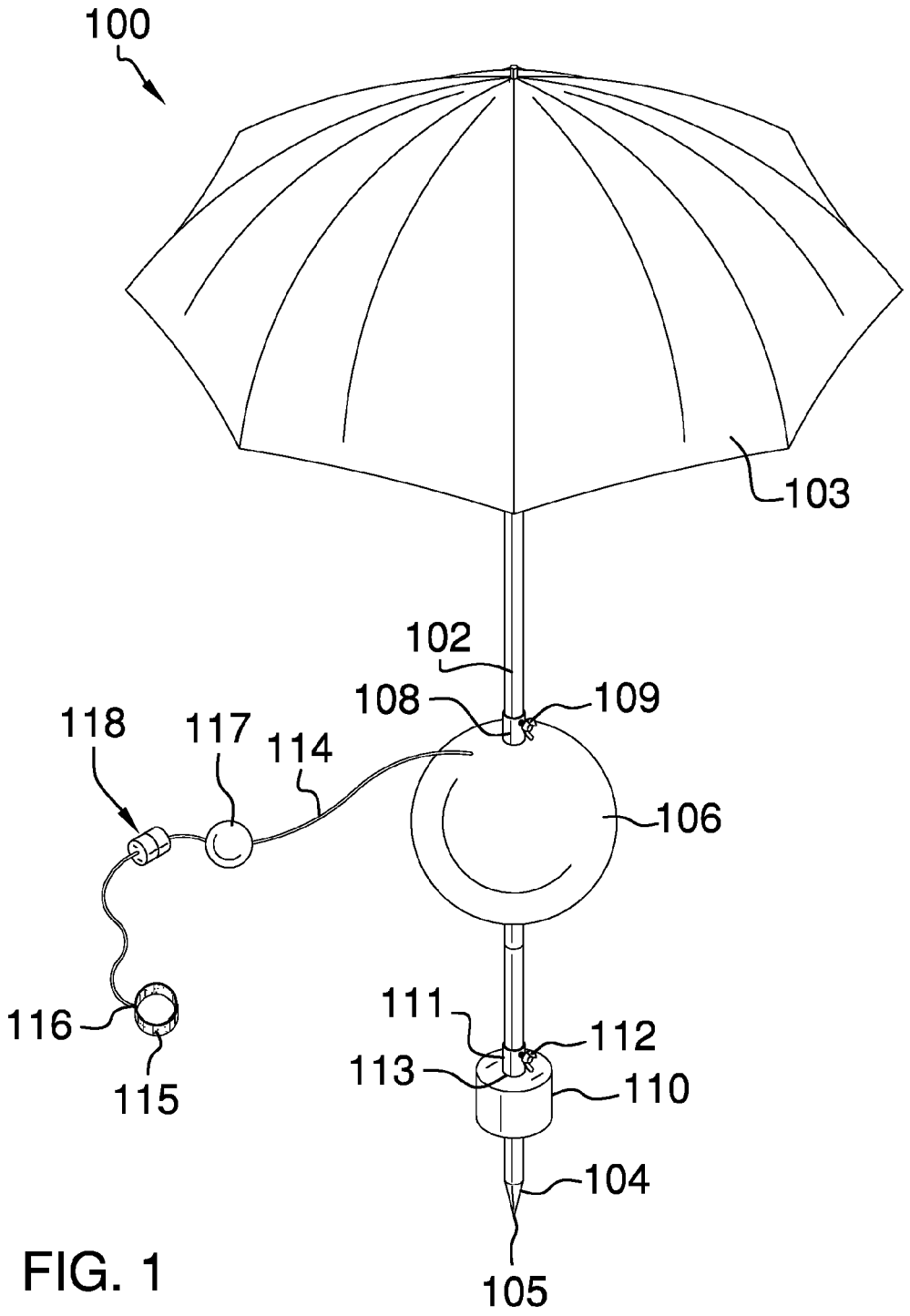
FIG. 1 is a perspective view of an embodiment of the disclosure.
Figure 2:
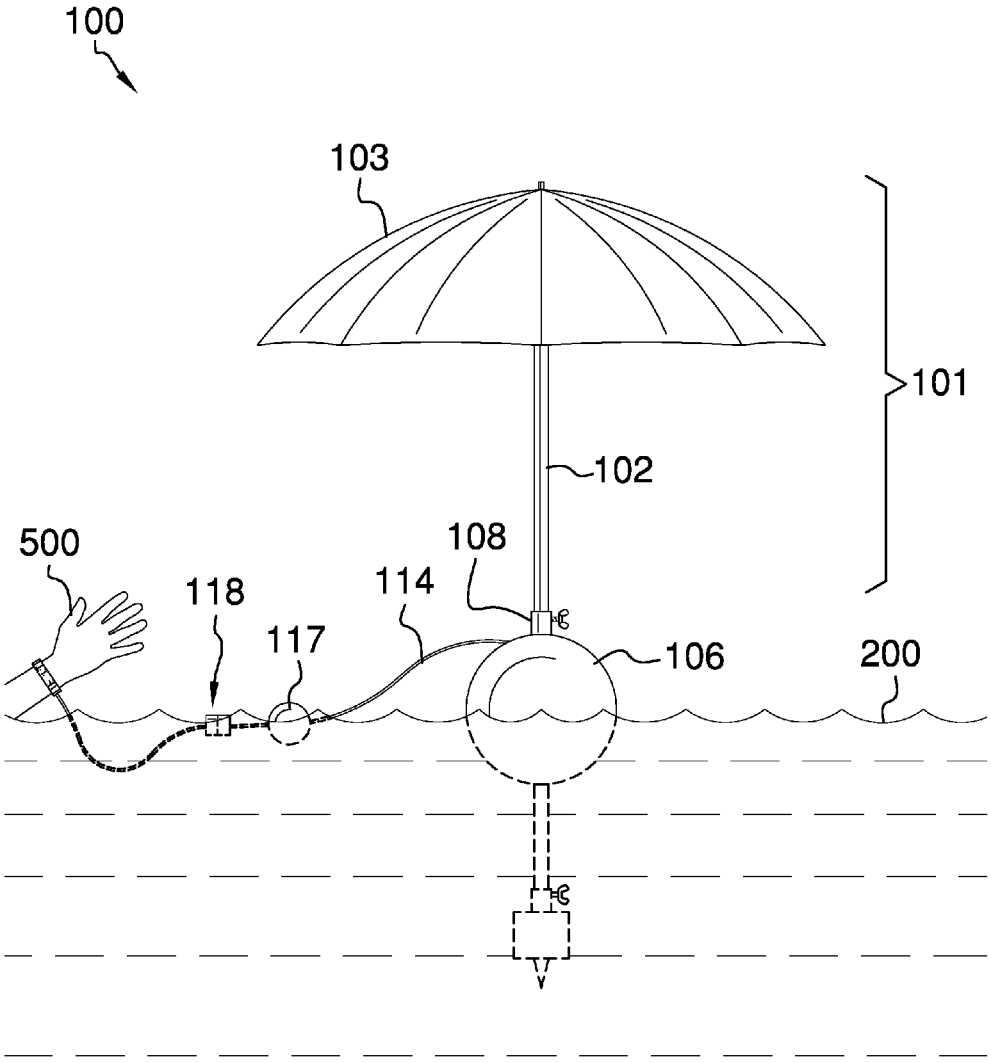
FIG. 2 is a side view of an embodiment of the disclosure in use.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a plurality potential embodiments of the disclosure, which are illustrated in FIGS. 1 through 5.

The floatable umbrella with self-ballasting member 100 (hereinafter invention) comprises an umbrella 101 that includes a pole 102 and canopy 103. The invention 100 may include the umbrella 101 or be adapted for use with the umbrella 101 as umbrellas are well known. The pole 102 of the umbrella 101 may include a point 104 at a distal end 105. The pole 102 is of an undefined length.

The invention 100 includes an umbrella float 106. The umbrella float 106 is able to be secured to the umbrella 101 so that the umbrella 101 is able to float when placed into a body of water 200 (see FIG. 2). The primary function of the invention 100 is to provide an umbrella that is able to float and remain ballasted whilst in said body of water 200. Obviously, the umbrella float 106 is made of a buoyant material such that the invention 100 enables the umbrella 101 to float in the body of water 200. The umbrella float 106 may be spherical in shape, and is further defined with pole holes 107 that are located distally from one another such that the pole 102 of the umbrella 101 is able to slide down through the umbrella float 106. The pole holes 107 are diametrically opposite from one another such that the pole 102 is centrally positioned with the umbrella float 106. A collar member 108 is provided at one of the two pole holes 107 of the umbrella float 106. The collar member 108 is rigidly affixed to the umbrella float 106 at the one of the two pole holes 107. The collar member 108 includes a setscrew 109 that when tightened secures the pole 102 to the umbrella float 106.

Once the umbrella float 106 is secured to the pole 102 via the collar member 108, an umbrella weight 110 is affixed to the pole 102. The umbrella weight 110 is affixed to the pole 102 below the umbrella float 106. In fact, the umbrella weight 110 is affixed to the pole 102 just above the distal end 105. The umbrella float 106 is affixed to the pole 102 in between the distal end 105 and the canopy 103. The umbrella weight 110 includes a second collar 111 with a second setscrew 112 that secures the umbrella weight 110 to the pole 102. The second collar 111 is rigidly affixed atop of the umbrella weight 110. The umbrella weight 110 also includes a bore-hole 113 that enables the umbrella weight 110 to slide onto the pole 102, which is analogous to the umbrella float 106. The umbrella weight 110 is made of a non-buoyant material that may involve a metal or a plastic housing filled with water and/or sand.

The invention 100 includes a tether 114 that is attached to and extends from the umbrella float 106. The tether 114 is of an undefined length and may involve a rope, wire, woven fabric, etc. The tether 114 is used to be adaptively secured to an end user 500. The tether 114 enables the invention 100 to stay in relative proximity to the end user 500.

The tether 114 includes a wristband 115 on a second distal end 116 of the tether 114. The second distal end 116 of the tether 114 shall be opposite of where the tether 114 is affixed to the umbrella float 106. The tether 114 includes a tether float 117 as well as a magnet release 118. Both the tether float 117 and the magnet release 118 are positioned midway along the tether 114. The magnet release 118 is positioned between the tether float 117 and the second distal end 116. The tether float 117 is spherical in shape, made of a buoyant material, and used to keep the magnet release 118 relatively visible when located in the body of water 200.

Figure 3:
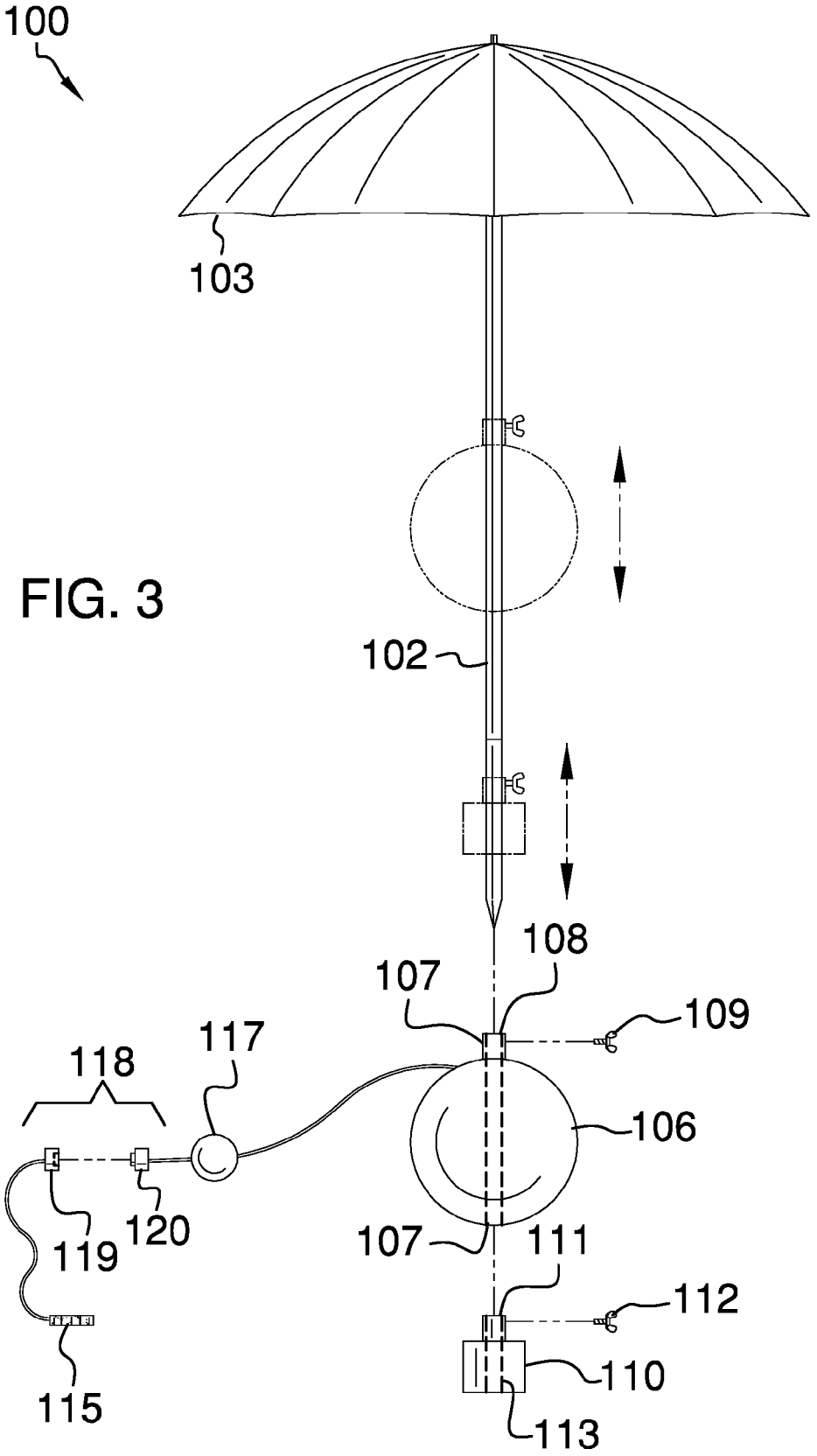
FIG. 3 is an exploded view of an embodiment of the disclosure.
Figure 4:
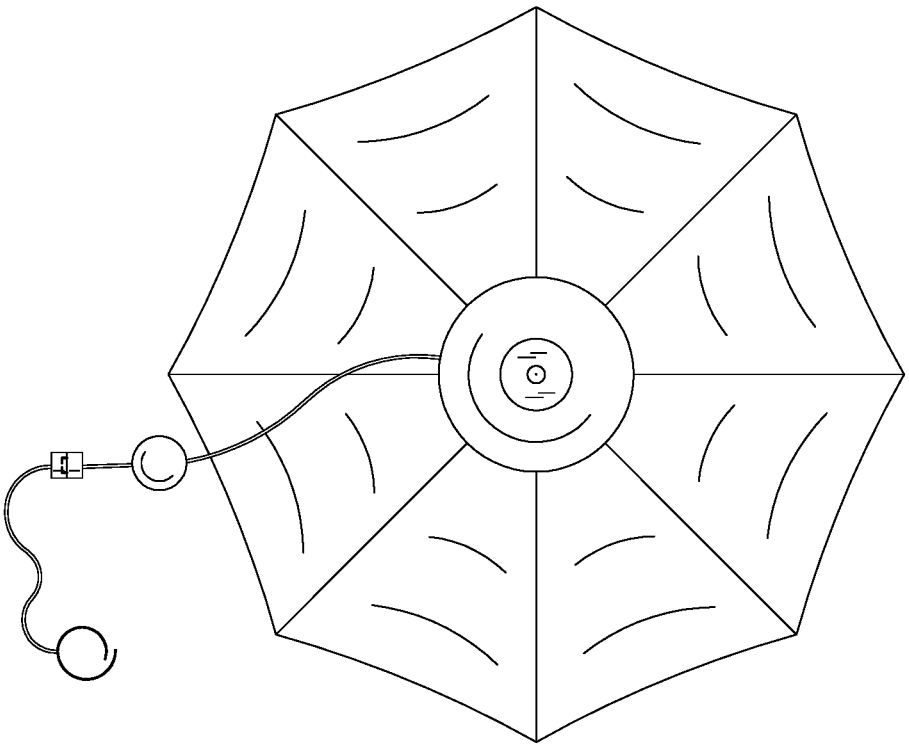
FIG. 4 is a bottom view of an embodiment of the disclosure.

Referring to FIG. 3, the magnet release 118 enables the wristband 115 to be temporarily disconnected from the umbrella float 106. In certain limited circumstances, the end user 500 may want to be disconnected from the invention 100, and the magnet release 118 facilitates this need. The magnet release 118 is comprised of a first magnet member 119 and a second magnet member 120 that are magnetically attracted to one another. The first magnet member 119 is attached to a portion of the tether 114 that is affixed to the wristband 115; whereas the second magnet member 120 is affixed to the portion of the tether 114 immediately adjacent to the tether float 117.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An umbrella comprising:

a pole with a canopy affixed thereon;

wherein an umbrella float is selectively positioned on said pole such that said umbrella is able to adaptively float in a body of water;

wherein an umbrella weight is selectively positioned on the pole in order to adaptively ballast said umbrella in said body of water;

wherein the pole is further defined with a point at a distal end; wherein the point at the distal end is opposite of where the pole is attached to the canopy;

wherein the umbrella float is spherical in shape, and is further defined with two pole holes that are located distally from one another such that the pole of the umbrella is able to slide down through the umbrella float;

wherein the pole holes are diametrically opposite from one another such that the pole is centrally positioned with the umbrella float;

wherein a collar member is provided at one of the two pole holes of the umbrella float;

wherein the collar member is rigidly affixed to the umbrella float at the one of the two pole holes;

wherein the collar member includes a setscrew that secures the pole to the umbrella float;

wherein the umbrella weight is affixed to the pole below the umbrella float;

wherein the umbrella weight is affixed to the pole just above the distal end;

wherein the umbrella float is affixed to the pole in between the distal end and the canopy;

wherein the umbrella weight includes a second collar with a second setscrew that secures the umbrella weight to the pole;

wherein the second collar is rigidly affixed atop of the umbrella weight;

wherein the umbrella weight is further defined with a bore-hole that enables the umbrella weight to slide onto the pole;

wherein the umbrella weight is made of a non-buoyant material;

wherein a tether is attached to and extends from the umbrella float;

wherein the tether is used to be adaptively secured to an end user;

wherein the tether includes a wristband on a second distal end of the tether;

wherein the second distal end of the tether is opposite of where the tether is affixed to the umbrella float;

wherein the tether includes a tether float;

wherein the tether includes a magnet release.

2. The umbrella according to claim 1 wherein both the tether float and the magnet release are positioned midway along the tether.

3. The umbrella according to claim 2 wherein the magnet release is positioned between the tether float and the second distal end; wherein the tether float is spherical in shape, made of a buoyant material, and used to keep the magnet release relatively visible when located in the body of water.

4. The umbrella according to claim 3 wherein the magnet release enables the wristband to be temporarily disconnected from the umbrella float.

5. The umbrella according to claim 4 wherein the magnet release is comprised of a first magnet member and a second magnet member that are magnetically attracted to one another.

6. The umbrella according to claim 5 wherein the first magnet member is attached to a portion of the tether that is affixed to the wristband; whereas the second magnet member is affixed to the portion of the tether immediately adjacent to the tether float.

* * * * *